United States Patent [19]

Behm

[11] 4,308,677

[45] Jan. 5, 1982

[54] EJECTOR TYPE SCRAPER

[75] Inventor: William C. Behm, McAllen, Tex.

[73] Assignee: Reynolds Manufacturing Company, Cedartown, Ga.

[21] Appl. No.: 148,181

[22] Filed: May 19, 1980

[51] Int. Cl.[3] ..... E02F 9/28

[52] U.S. Cl. ..... 37/126 AE; 37/129

[58] Field of Search ..... 37/124, 126 R, 126 AE, 37/129, 8

[56] References Cited

U.S. PATENT DOCUMENTS

| | | | |
|---|---|---|---|
| 3,693,273 | 9/1972 | Sullivan | 37/129 |
| 3,739,504 | 6/1973 | Miller | 37/126 AE |
| 3,742,628 | 7/1973 | Walser et al. | 37/126 AE |
| 3,931,687 | 1/1976 | Johns, Jr. | 37/126 AE X |
| 3,995,383 | 12/1976 | Breitenstein et al. | 37/126 AE |
| 4,041,625 | 8/1977 | Fisher et al. | 37/126 AE |
| 4,109,400 | 8/1978 | Richardson | 37/129 X |
| 4,133,122 | 1/1979 | Girard et al. | 37/126 AE |

*Primary Examiner*—E. H. Eickholt

*Attorney, Agent, or Firm*—Marvin B. Eickenroht; Jennings B. Thompson

[57] ABSTRACT

There is disclosed an ejector type scraper wherein an ejector having a generally vertical front face is moved between rearward and forward positions, during loading and unloading of the bucket of the scraper, by means of hydraulically operated, extendible and retractable actuators mounted on the opposite side walls of the bucket.

11 Claims, 7 Drawing Figures

1
1
4
4
50L
24
40
41
23
26
27A
22
28
25
23
27
29
32
40
5
5
24
50R
2
2

22
27
27A
39
26
25
28
36
40
30
32
29
23
31

22
G
25
47
39
42
38
40
48
50R
37
51
30
23

EJECTOR TYPE SCRAPER

This invention relates to improved scrapers of the ejector type which are normally used to level off high spots and fill in low spots of the ground surface, but which may also be used to remove soil to a predetermined depth below the ground surface for deposit at another location.

A scraper of this type comprises a bucket having side walls and a bottom wall which form an open front end through which soil may pass to load the bucket. The bottom wall has a forwardly extending blade which provides a cutting edge to remove the soil when the bucket is in a lower, generally horizontal position, and an ejector having a generally vertical front face is supported by the bucket for extension thereacross from one side wall to the other and just above the bottom wall to permit it to be moved between a rearward position as the bucket is loaded and a forward position near the cutting edge to eject soil therefrom.

Generally, the bucket is towed behind a tractor and supported from rear wheels which roll over the ground surface as the scraper moves forwardly with the tractor. Extendible and retractable actuators permit the bucket to be raised into an upper position for transport purposes and then lowered back to its loading position. In such upper position, the bottom wall is more forwardly inclined toward its cutting edge to assist in unloading soil through its open, front end.

In prior scrapers of this type, the ejector has been moved between its rearward and forward positions by means of hydraulically operated, extendible and retractable actuators, which, together with the ejector itself, are supported by means of rollers mounted on a frame extending longitudinally behind the ejector. The ejector, which is often sixteen to eighteen feet in width, may bind with the walls of the bucket, or even buckle, should it encounter an obstruction during movement toward its forward position.

This is a particular problem when the ejector is moved by means of laterally spaced actuators which are unevenly loaded by an obstruction to one side or the other of the ejector. Although flow dividers may be used to equalize the flow of hydraulic fluid to and from actuators of this type, they would not always be sufficiently efficient to prevent the wide ejectors from binding under these conditions of unequal loading. Also, flow dividers are expensive and generate considerable heat.

Since the ejector extends as a cantilever from the rear frame of the above-described prior scraper, the frame is massive and expensive. Also, rollers may be necessary to engage the bottom wall of the bucket to hold the lower edge of the ejector out of contact with the bottom wall of the bucket. In addition, the roller-type supports on the frame may be inadequate to prevent the front mounted ejector from twisting in both horizontal and vertical planes.

An object of this invention is to provide a scraper of this type in which the ejector is prevented from binding as it is moved between its forward and rearward position.

Another object is to provide such a scraper having a simple and inexpensive hydraulic system for causing the ejector actuators to act in unison as they move the ejector between its forward and rearward positions.

Still another object is to provide such a system which automatically replaces hydraulic fluid which is lost therefrom and/or removes air which enters the system.

A further object of this invention is to provide such a scraper in which the ejector, and preferably the actuators as well, are supported by a roller system which does not require a frame behind the ejector or a large number of rollers or other load bearing parts.

These and other objects are accomplished, in accordance with the illustrated embodiment of the invention, by a scraper of the type described wherein the ejector is moved between its rearward and forward position by means which includes a pair of hydraulically operated, extendible and retractable actuators each of which is connected at one end to a side wall of the bucket and at the other end to the ejector near one side edge thereof. When located in this manner, and supported from a roller system mounted on the side wall of the bucket as will be described, the scraper obviates the need for the rear frame heretofore thought necessary.

Each actuator is of the same size and comprises a cylinder, a piston reciprocable in the cylinder, and a rod in the piston projecting from one end of the cylinder, and the actuators are reversed end for end so that the rod of one extends as the rod of the other retracts in moving the ejector between its rearward and forward positions. A first conduit means connects the cylinders with one another on one side of the pistons thereof so that hydraulic fluid which fills the conduit means and the cylinders on such one side of the pistons will transmit the movement of one piston to the other, and a second conduit means introduces hydraulic fluid into one cylinder while exhausting it from the other cylinder on the other sides of the pistons thereof. As a result of this arrangement, wherein one actuator acts as a master and the other as a slave as the ejector moves to one position, and the other acts as the master and the one as the slave as the ejector moves to the other position, each actuator and thus each end of the ejector is caused to move in unison, whereby the ejector is held against binding despite unbalanced loading. More particularly, the first conduit means preferably connects the cylinders on the sides of the pistons thereof from which the rods extend, so that hydraulic fluid is admitted to the side of each cylinder having the larger area to produce maximum force for moving the ejector between its alternate positions.

In the preferred and illustrated embodiment of the invention, the opposite ends of the ejector as well as the free ends of the actuator are guidably supported on the outer side of the side wall of the bucket. More particularly, the rollers are also disposed on the outside of the bucket and thus removed from within the loading area of the bucket. Since the ejector is supported at its opposite ends, and thus not as a cantilever, as in prior scrapers of this type, fewer and/or smaller rollers are required.

The first conduit means of the hydraulic system preferably includes a main conduit connecting at each end with a cylinder near the one end thereof, and a bypass conduit connecting the main conduit with the cylinder to supply hydraulic fluid from the second conduit means to the other cylinder as the piston in said one cylinder reaches the end of its movement during movement of the ejector to one of its positions. The second conduit means includes a pair of main conduits each connecting with a cylinder near the other end thereof, and a bypass conduit connecting the main conduit with the other cylinder to exhaust hydraulic fluid through the second conduit means as the piston in said other cylinder reaches the end of its movement during movement of the ejector to its other position. As a consequence, if a piston of the cylinder of either actuator bottoms out before the piston of the other cylinder, due to a loss of operating fluid or due to air in the system, or both, additional hydraulic fluid will be automatically supplied to the deficient cylinder.

In the preferred and illustrated embodiment of the invention, the ejector is supported from the bucket by means of a guide extending longitudinally along the outer side of each side wall, and a carriage supported on each guide for movement longitudinally of the bucket and having means which passes through an opening or slot in each side wall to connect with the ejector near one side edge thereof. Each of the pair of actuators is connected to the carriage on the side wall so that its weight is carried by the carriage as well as by the side wall of the bucket. The guide is preferably a track, and each carriage includes a pair of longitudinally spaced rollers in rolling engagement with the track. The rollers of each pair are forward and rearward of the ejector so as to reduce any tendency for the ejector to tip forwardly or rearwardly due to unequal loading or obstructions. The carriage and actuator on the outer side of each side wall of the bucket are arranged generally one above the other, with the actuator on the outer side of each wall being beneath and having its outer end suspended from the carriage supported on the guide and mounted on such side wall.

In the drawings, wherein like reference characters are used throughout to designate like parts:

Figure 1:
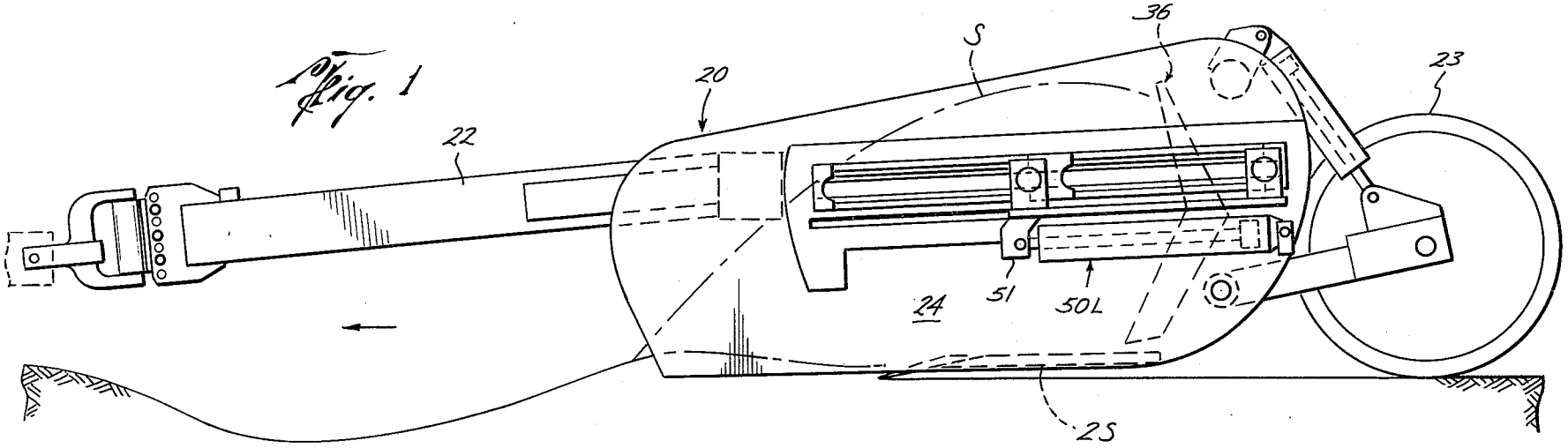
FIG. 1 is an elevational view of one side of a scraper constructed in accordance with the present invention, as seen from broken lines 1—1 of FIG. 3.

With reference now to the details of the above-described drawings, the overall scraper, which is indicated in its entirety by reference character 20, includes a bucket 21 and a neck 22 extending from the front end of the bucket for connection to a tractor (not shown) to permit the scraper to be towed with the tractor forwardly over the ground surface G. The rear end of the bucket is supported by wheels 23 at each side thereof which roll along the ground surface.

Figure 2:
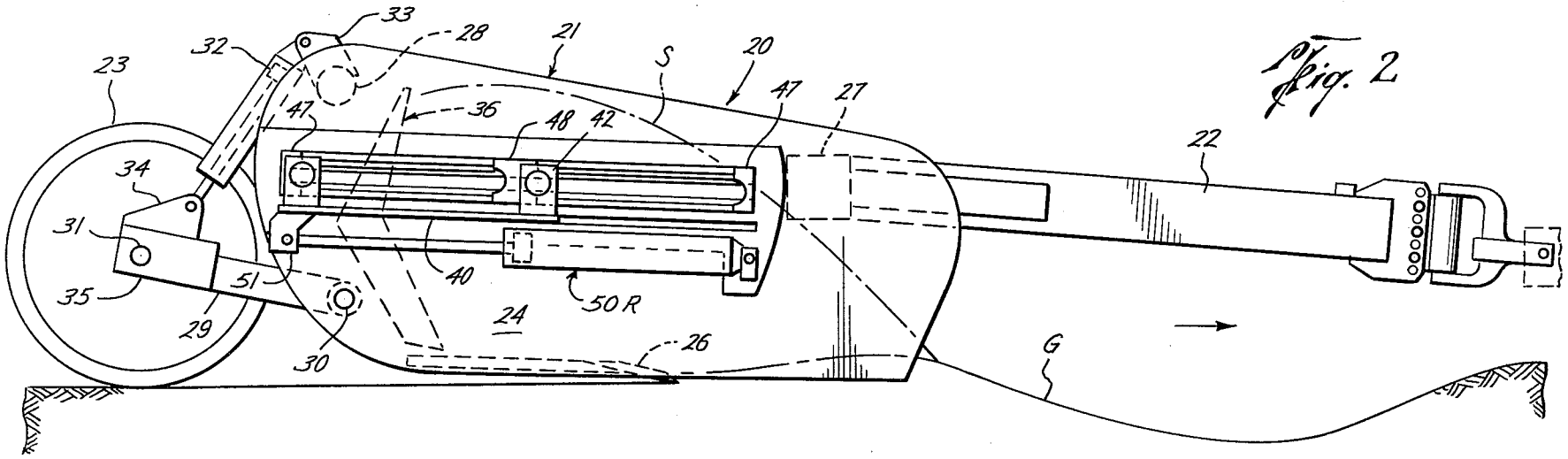
FIG. 2 is an elevational view of the other side of the scraper, as seen from broken lines 2—2 of FIG. 3.
Figure 3:
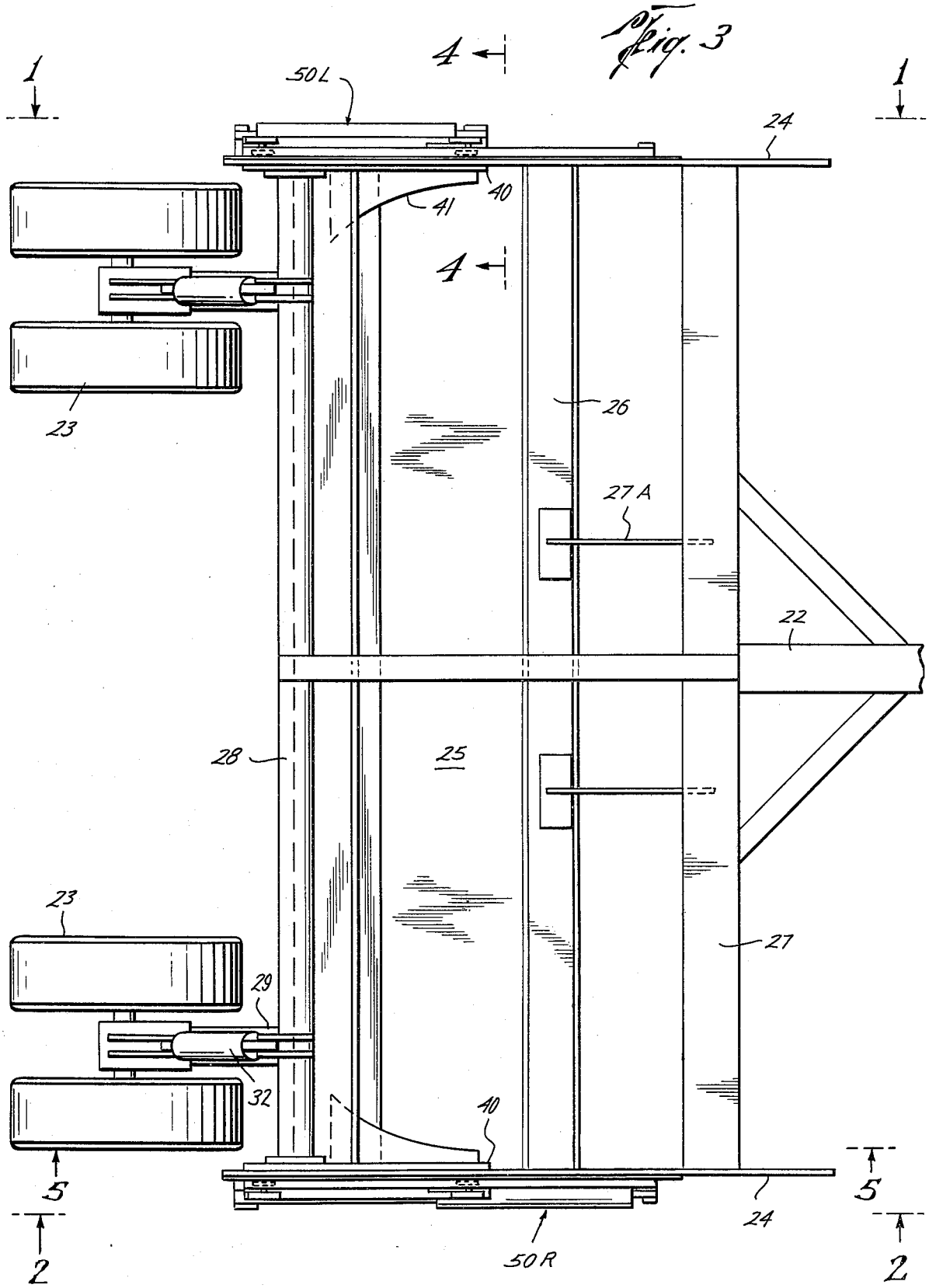
FIG. 3 is a top plan view of the scraper, as seen from above FIG. 2, and with a major portion of the towing neck removed for purposes of illustration.
Figure 4:
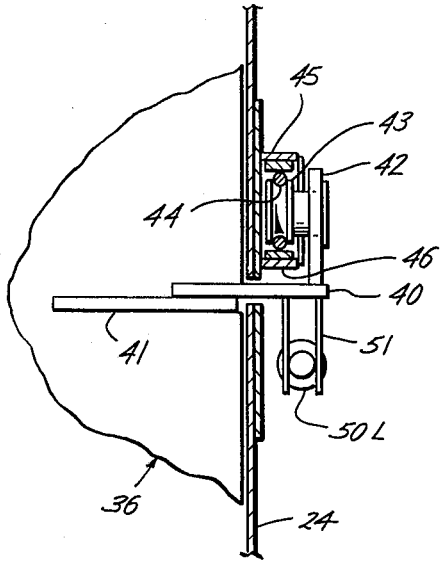
FIG. 4 is a detailed, sectional view of the means by which the ejector of the scraper is supported from the bucket thereof, as seen along broken lines 4—4 of FIG. 3.
Figure 5:
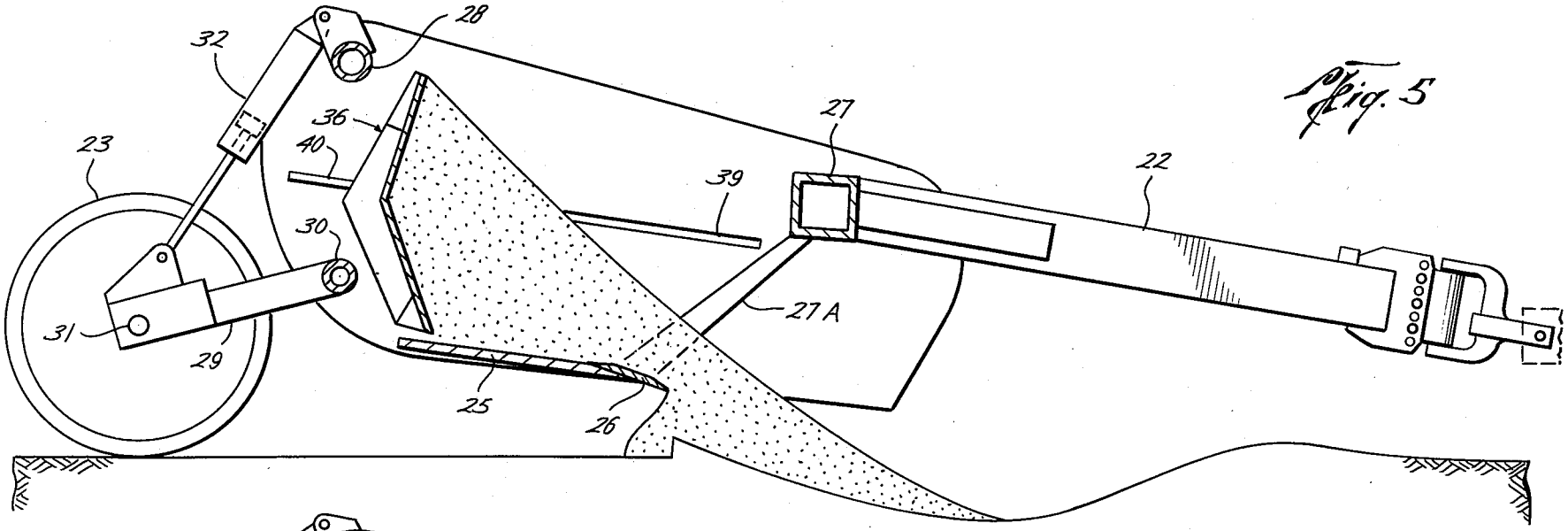
FIG. 5 is a longitudinal, cross-sectional view of the scraper, as seen along broken lines 5—5 of FIG. 3, but upon raising of the bucket to its unloading position.
Figure 6:
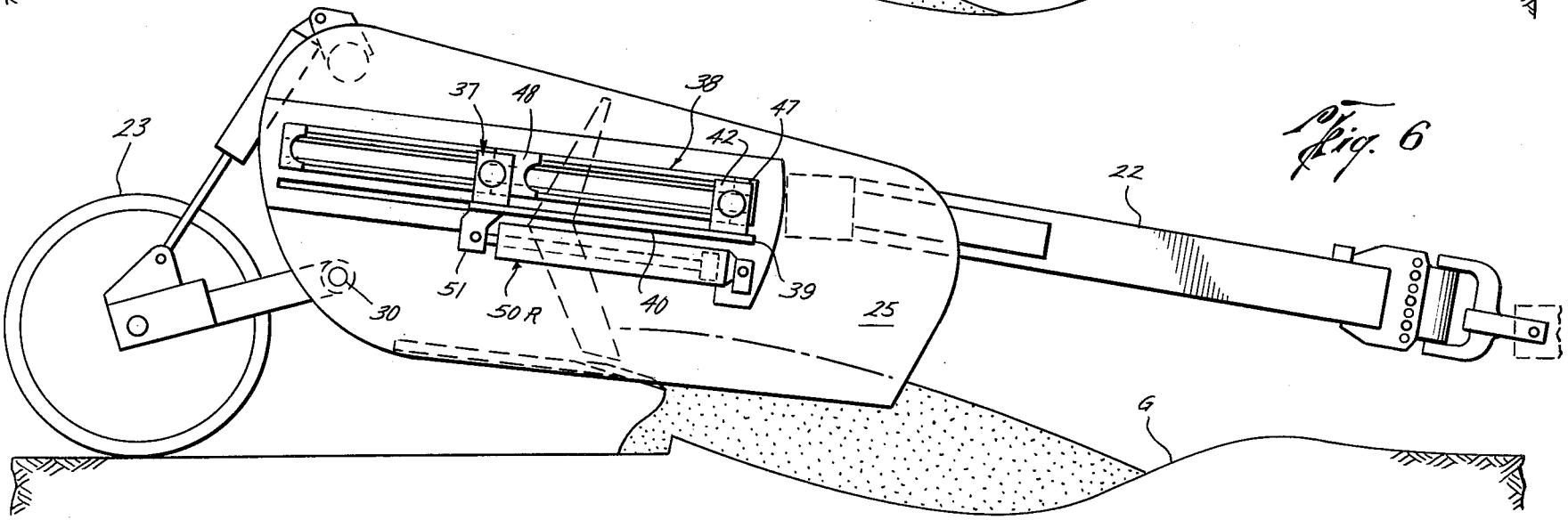
FIG. 6 is a side elevational view of the scraper, similar to FIG. 2, but with the bucket in the raised position of FIG. 5, and the ejector moved from the rearward position of FIG. 5 to the forward position.

The wheels may be lowered to lift the bucket from the loading position of FIGS. 1 and 2 to the unloading or transport position of FIGS. 5 and 6. Conversely, the wheels may be raised to permit the bucket to be lowered from the unloading position back to a loading position. Still further, the elevation of the wheels may be regulated in a manner which will be apparent from the description to follow so as to penetrate the ground surface to a predetermined depth. However, in normal use, the cutting edge will be maintained at substantially the same level as the wheel supports for the tractor and the bucket so as to level the ground surface. If the scraper is to be used for "carryall" purposes, the cutting edge is lowered further so as to remove soil to a predetermined depth below the ground surface in order to deposit it at another location.

The bucket 21 comprises side walls 24 and a bottom wall 25 extending between the side walls to provide an open front end through which soil may pass to load the bucket as the bucket moves forwardly over the ground surface. The bottom wall terminates short of the front ends of the side walls and has a blade providing a forwardly extending cutting edge 26 thereacross which slices into the ground level, as best shown in FIGS. 1 and 2.

The side walls are connected by a cross bar 27 near the front end of the scraper and a cross bar 28 near the rear end thereof. The front bar 27 is spaced above the bottom wall 25 to provide a large opening through which soil may pass into the bucket. The towing neck 22 is connected to and extends forwardly from a mid portion of the bar 27. Struts 27A also connect cross bar 27 to the bottom wall of the bucket.

Bucket 21 is supported from wheels 23 on opposite sides thereof by means of arms 29 whose forward ends are pivotally connected to the side walls of the bucket by pins 30 and whose rearward ends are connected to a journal box 35 for the axle 31 of each pair of wheels. Hydraulically operated, extendible and retractable actuators 32 are pivotally connected at their upper ends to ears 33 on the bar 28 and at their lower ends to ears 34 on journal box 35. As will be apparent from the drawings, extension of the actuators will swing arms 29 about pins 30 to lower the wheels in order to raise the bucket, while retraction of the actuators will raise the wheels in order to permit the bucket to be lowered to its unloading or transport position. The actuators are selectively extended and retracted by an hydraulic system which is shown diagrammatically in FIG. 7 to be described hereinafter.

An ejector 36 comprising a wall having a generally vertical front face is supported at its opposite ends for extension transversely across the bucket from one side wall to the other and with its lower edge above the bottom wall of the bucket to permit the ejector to be moved longitudinally between the rearward position of FIGS. 1 and 2 during loading of the bucket and the forward position of FIGS. 5 and 6 to eject soil from the bucket during unloading. As shown, the ejector wall is of wide V-shape in cross section and is reinforced on the back side thereof by vertical ribs. As previously described, each opposite end of the ejector is connected to a carriage which is supported on a guide 38 which extends longitudinally along the outer side of a mounting plate on each side wall of the bucket.

Each such carriage includes a long plate 39 which extends through a slot 40 in the side wall of the bucket for connection along its inner side edge to a horizontally disposed, reinforcing blade 41 on the front side of the blade. A wall 42 extends vertically from the outer edge of plate 39 to mount rollers 43 for rolling along a track 44 having upper and lower rails mounted on upper and lower support walls 45 and 46 of the guide 38. More particularly, each such carriage includes a pair of longitudinally spaced-apart rollers 43 opposite the front and rear sides of the blade 36. The upper and lower rail supporting walls are connected in fixed spaced relation by straps 47 at opposite ends thereof and strap 48 intermediate their ends.

As previously described, ejector 36 is moved between the rearward position shown in FIGS. 1, 2, 3 and 5, and the forward position shown in FIG. 6 by means of a pair of hydraulically operated, extendible and retractable actuators, the right hand actuator (looking forwardly) being designated 50R, and the left hand actuator being designated 50L. More particularly, and as will also be described to follow, each such actuator is disposed on the outer side of the side wall of the bucket beneath the carriage. As previously mentioned, the actuators are of the same size and reversed end for end so that the rod of one extends as the other retracts. The hydraulic system by which the actuators are selectively extended and retracted, in order to move the ejector between its rearward and forward positions, is illustrated diagrammatically in FIG. 7, to be described to follow.

With the bucket lowered to the position shown in FIGS. 1 and 2, and the ejector 36 withdrawn to its rearward position, soil will accumulate within the bucket, as indicated by the interrupted lines S of FIGS. 1 and 2, as the scraper moves forwardly over the ground surface G. As the cutting edge 26 on the forward end of the lower wall of the bucket removes the high spots in the ground surface, some of the soil which is loaded in the bucket is free to fall into low spots. Alternatively, and as also previously described, the bucket may be lowered further to cut a trench or depression in a normally flat ground surface.

When it is desired to unload the bucket, actuators 32 are extended to raise it to the position shown in FIG. 5. Due to the arrangement of the wheel supporting arms 29 with respect to the bucket, the bucket is tilted forwardly somewhat as it is so raised. Consequently, the bottom wall 25 of the bucket is inclined at a somewhat larger angle than the slight angle it assumes when the bucket is lowered to the position of FIGS. 1 and 2. Due to this tilting of the bucket, soil within the bucket rearwardly of the cutting edge 26 will spill onto the ground surface beneath the bucket, as shown in FIG. 5.

However, as also shown in FIG. 5, some of the soil normally remains in the bucket. This remaining soil is removed from the open front end of the bucket by movement of the ejector 36 from the rearward position of FIG. 5 to the forward position of FIG. 6, in which latter position the lower end of the ejector is close to the cutting edge 26 of the bottom wall of the bucket. If the scraper is to be transported to another location, the bucket will be held in its upper position, and the ejector preferably moved back to its rearward position. At another location, the bucket may be lowered to permit additional levelling operations to be performed.

As previously described, each actuator 50R and 50L is connected at one end to the outer side of the side wall of the bucket and at the opposite end to the carriage 37 on such side wall. Thus, as shown in the drawings, the outer end of the cylinder of each actuator is pinned to a mounting plate wall of the side wall of the bucket, and the outer end of the rod for the piston reciprocable in the cylinder is pinned to stirrups or hangers 51 which depend from the bar 39 of the carriage. Inasmuch as the actuators are reversed end for end, the rod extends rearwardly from the forwardly mounted cylinder in the case of the right hand actuator 50R, while the rod extends forwardly from the rearwardly mounted cylinder in the case of the left hand actuator 50L.

Figure 7:
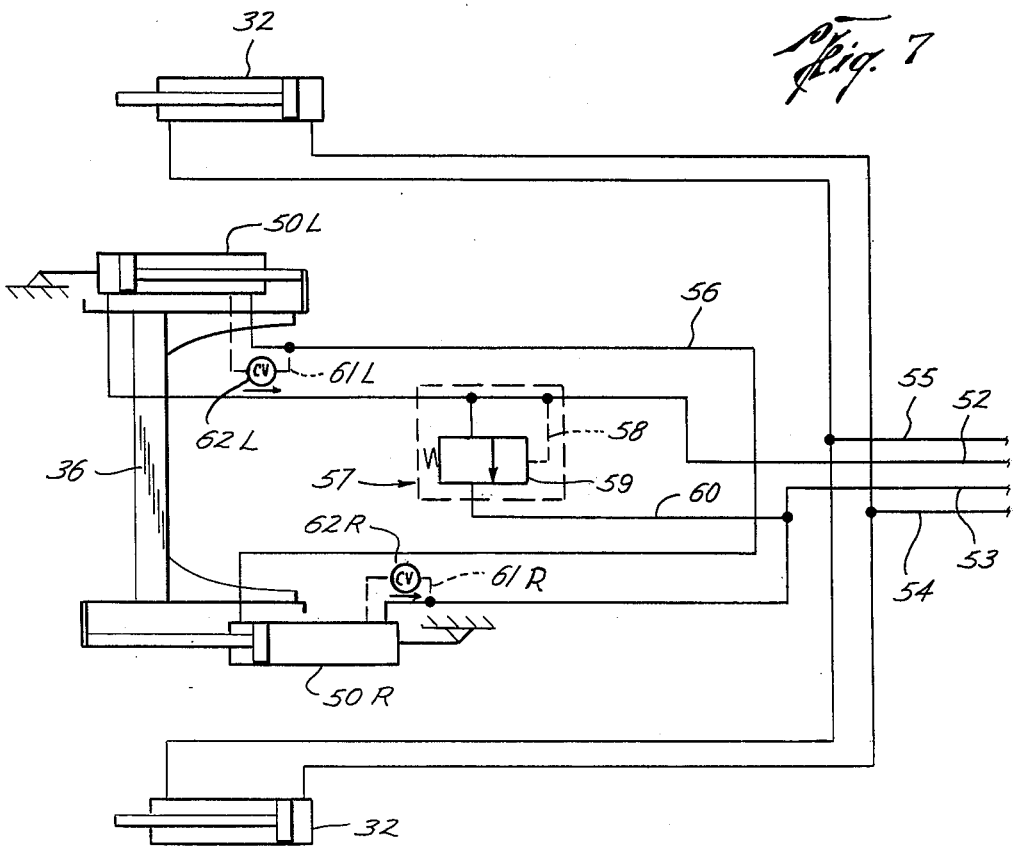
FIG. 7 is a diagrammatic illustration of the hydraulic system for operating the ejector and wheels.

As shown in FIG. 7, the hydraulic system includes a pair of conduits 52 and 53 which lead from and to a reversing valve (not shown) connected in conventional fashion to a source of hydraulic fluid and a sump therefor. Thus, the valve may be selectively operated in a well known manner to introduce such fluid into one conduit while exhausting it from the other. As will be described to follow, these conduits connect with the actuators 50R and 50L to cause them to move in unison as the ejector moves between rearward and forward positions.

As also shown in FIG. 7, additional conduits 54 and 55 extend from another such reversing valve (not shown) connecting with another or the same source of hydraulic fluid. These conduits connect with opposite ends of the cylinders 32 in order to selectively introduce such hydraulic fluid into one end thereof while exhausting it from the other end in order to raise or lower wheels 23. Thus, fluid is introduced into line 54 leading to the piston ends of the cylinders, while being withdrawn through the conduits 55 connecting with the rod ends thereof in order to move the pistons to the left and thus extend the rods to the position shown in FIGS. 5 and 6. Conversely, when it is desired to raise the wheels and thus lower the bucket to its levelling position, the reversing valve of the hydraulic system is moved to its alternate position for introducing fluid through conduit 55 to the rod ends of the cylinders of the actuators 32, while exhausting fluid from the piston ends thereof through the conduit 54.

As previously described, the ejector actuators are of equal size and so connected to the conduits 52 and 53 and to one another that one acts as a master and the other as a slave as they operate in unison to move the ejector between its rearward and forward positions. Thus, as shown, conduit 52 connects with the left hand or piston end of the cylinder of the actuator 50L, a conduit 56 connects the right hand or rod end of the cylinder of actuator 50L to the left hand or piston end of the cylinder of actuator 50R, and conduit 53 leads from the right hand or piston end of actuator 53. Thus, hydraulic fluid in the conduit 56 and the rod ends of the cylinders fluidly connect the pistons thereof to one another to cause them to move one in response to the other and thus in unison.

Assuming the ejector actuators to be in the position shown in FIG. 7, wherein the actuator 50L is withdrawn and the actuator 50R is extended to hold the ejector 36 in the rearward position, hydraulic fluid may be introduced through the conduit 52 into the left hand or piston end of the cylinder of actuator 50L, while being withdrawn from the right hand or piston end of the cylinder for the actuator 50R through conduit 53. This will extend the actuator 50L while withdrawing the actuator 50R in order to move the ejector 36 to its forward position. Since the piston ends of the cylinders of the two actuators move in unison with the other, as above described, there is no tendency for the ejector to bind despite uneven loading as it is moved forwardly to eject soil from the bucket. Obviously, the ejector can be moved back to its rearward position by manipulation of the reversing valve.

Preferably, a means 57 is provided for relieving hydraulic fluid from conduit 52 in the event it should reach an excessive pressure due to overloading of the ejector as it is moved to its forward position. For this purpose, a pilot line 58 connects conduit 52 with one end of a shiftable relief valve 59 which is normally spring pressed to the right hand, closed position shown in FIG. 7. When the overload situation is reached, fluid pressure in pilot valve 58 shifts valve 59 to the open position to connect a bypass line 60 with conduit 52 and conduit 53 and thereby permit hydraulic fluid to return to the sump.

As previously described, a means is provided for replacing hydraulic fluid which might be lost from the hydraulic system, or for eliminating air in the system, or both, to insure that the actuators 50R and 50L continue to act in unison. For this purpose, a bypass conduit 61L connects conduit 56 with the cylinder of actuator 50L a short distance to the left of conduit 56, and a bypass conduit 61R connects conduit 56 with the cylinder of actuator 50R just to the left of conduit 56. More particularly, this spacing is such that, in the case of the actuator 50L, bypass conduit 61L will connect with the cylinder on the left side of the piston as the piston thereof bottoms out during extension of the actuator, and in the case of the actuator 50R, bypass conduit 61R will connect with the cylinder thereof on the left side of the piston as such piston bottoms out during retraction of the actuator 50R.

By virtue of this arrangement, hydraulic fluid is automatically supplied to the cylinder of one actuator if the piston of the other actuator bottoms out before the piston of such one actuator during movement of the blade from the rearward to the forward position. In like manner, air is automatically removed from one cylinder should its presence in the cylinder cause the piston of one actuator to bottom out before the piston of the other actuator.

Thus, assume that, during extension of actuator 50L and retraction of actuator 50R in moving the ejector 36 to its forward position, the piston of actuator 50L bottoms out before the piston of actuator 50R. In this case, hydraulic fluid in the cylinder of actuator 50L will pass through bypass conduit 61L and conduite 56 into the cylinder of actuator 50R on the left side of the piston thereof. In this way, hydraulic fluid from conduit 52 will condinue to be supplied to the cylinder of actuator 50R on the left side of the piston thereof until that piston bottoms out. When this occurs, the hydraulic fluid admitted to the cylinder of actuator 50R through conduit 56 will flow through bypass conduit 61R into the exhaust line 53.

On the other hand, if the piston of actuator 50R bottoms out before the piston of actuator 50L, during this same forward movement of the ejector, hydraulic fluid supplied to the cylinder of actuator 50R through conduit 56 will flow through bypass conduit 61R into the exhaust line 53. In this way, hydraulic fluid supplied through conduit 52 is free to continue to flow into the cylinder of actuator 50L on the left hand side of the piston thereof, and thus to continue to move the piston of the actuator 50L toward the right. This will continue as hydraulic fluid flows through conduit 56L, from the piston of actuator 50L to the piston of actuator 50R, and then into the exhaust line 53 through bypass conduit 51R.

As shown in FIG. 7, there is a one-way check valve 62L in bypass line 61L and a one-way check valve 62R in bypass line 61R. As indicated by the arrow adjacent thereto, each such check valve permits flow from left to right and thus does not interfere with the above-described function of either such bypass line. On the other hand, each such check valve prevents flow from right to left. Thus, as the ejector begins to move from its forward to its rearward position, hydraulic fluid supplied through conduit 53 will not bypass the piston of actuator 50R, and hydraulic fluid supplied through conduit 56 will not bypass the piston of actuator 50L.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. An ejector type scraper, comprising a bucket having side walls and a bottom wall forming an open front end through which soil passes to load the bucket as it is moved forwardly over the ground surface, an ejector having a generally vertical front face extending across the bucket from one side wall to the other and supported by the bucket for movement between a rearward position as the bucket is loaded and a forward position to eject soil therefrom, and a pair of hydraulically operated, extendible and retractable actuators each connected at one end to a side wall of the bucket and at the other end to the ejector near one side edge thereof, each actuator being of the same size and comprising a cylinder, a piston reciprocable in the cylinder, and a rod on the piston projecting from one end of the cylinder, said actuators being reversed end for end so that the rod of one extends as the rod of the other retracts in order to move the ejector between its rearward and forward positions, first conduit means connecting the cylinders with one another on one side of the pistons thereof so that hydraulic fluid which fills the conduit means and the cylinders on said one side of the pistons will transmit the movement of one piston to the other, and second conduit means for introducing hydraulic fluid into one cylinder while exhausting it from the other cylinder on the other side of the pistons thereof.

2. A scraper of the character defined in claim 1, wherein the first conduit means connects the cylinders on the sides of the pistons thereof from which the rods extend.

3. A scraper of the character defined in claim 1, wherein the first conduit means includes a main conduit connecting at each end with a cylinder near the one end thereof, and a bypass conduit connecting the main conduit with one of the cylinders to supply hydraulic fluid from the second conduit means to said other cylinder as the piston in said one cylinder reaches the end of its movement during movement of the ejector to one of its positions, and the second conduit means includes a pair of main conduits each connecting with a cylinder near the other end thereof, and a bypass conduit connecting the main conduit with the other cylinder to exhaust hydraulic fluid through the second conduit means as the piston in said other cylinder reaches the end of its movement during movement of the ejector to said one position.

4. A scraper of the character defined in claim 1, wherein each actuator is disposed on the outer side of the side wall of the bucket to which its one end is connected.

5. A scraper of the character defined in claim 4, including means on the outer side of each side wall of the bucket supporting the ejector near its adjacent end for guided movement between its rearward and forward positions.

6. A scraper of the character defined in claim 5, wherein the other end of each actuator is connected to the supporting means on the outer side of the adjacent side wall of the bucket.

7. An ejector type scraper, comprising a bucket having side walls and a bottom wall forming an open front end through which soil passes to load the bucket as it is moved forwardly over the ground surface, an ejector having a generally vertical front face extending across the bucket from one side wall to the other, a longitudinally extending guide on the outer side of each side wall, a carriage supported on each guide for guided movement longitudinally of the bucket and having means passing through an opening in each side wall to connect with the ejector near one side edge thereof so as to support the ejector for movement with the carriage between a rearward position as the bucket is loaded and a forward position to eject soil therefrom, a pair of hydraulically operated, extendible and retractable actuators each connected at one end to the outer side of a side wall of the bucket and at the other end to the carriage on said side wall so as to move the carriage longitudinally of the track and thus move the ejector between rearward and forward positions as the actuators are extended and retracted, and a hydraulic system for so extending and retracting the actuators.

8. A scraper of the character defined in claim 7, wherein the guide is a track, and each carriage includes a pair of longitudinally spaced rollers in rolling engagement with the track.

9. A scraper of the character defined in claim 8, wherein the rollers of each pair are forward and rearward of the side edge of the blade.

10. A scraper of the character defined in claim 7, wherein the carriage and actuator on the outer side of each side wall of the bucket are arranged generally one above the other.

11. A scraper of the character defined in claim 10, wherein the actuator on the outer side of each side wall is beneath and has its other end suspended from the carriage supported on the guide mounted on said side wall.

* * * * *